US007648306B2

(12) United States Patent
Schwörer

(10) Patent No.: US 7,648,306 B2
(45) Date of Patent: Jan. 19, 2010

(54) CONCRETE SHELL ASSEMBLY

(75) Inventor: Artur Schwörer, Senden (DE)

(73) Assignee: Peri GmbH, Weissenhorn (DE)

( * ) Notice: Subject to any disclaimer, the term of this patent is extended or adjusted under 35 U.S.C. 154(b) by 380 days.

(21) Appl. No.: 10/563,487

(22) PCT Filed: Jul. 2, 2004

(86) PCT No.: PCT/DE2004/001409

§ 371 (c)(1),
(2), (4) Date: Apr. 26, 2006

(87) PCT Pub. No.: WO2005/005750

PCT Pub. Date: Jan. 20, 2005

(65) Prior Publication Data

US 2006/0239769 A1 Oct. 26, 2006

(30) Foreign Application Priority Data

Jul. 5, 2003 (DE) ..... 103 30 462

(51) Int. Cl.
*F16B 2/02* (2006.01)

(52) U.S. Cl. ..... 403/373; 403/107; 403/108; 403/321; 249/45; 249/192

(58) Field of Classification Search ..... 403/104, 403/105, 106, 107, 108, 321, 373, 322.1, 403/322.4, 374.1, 374.2; 249/44, 45, 47, 249/191, 192, 193, 195, 219.1
See application file for complete search history.

(56) References Cited

U.S. PATENT DOCUMENTS 1,593,610 A 4/1926 White
3,550,898 A * 12/1970 Citrullo et al. ..... 249/195
4,880,204 A 11/1989 Steele
4,881,716 A * 11/1989 Dingler ..... 249/192
5,146,816 A * 9/1992 Badstieber ..... 81/487
5,975,483 A * 11/1999 Schule ..... 249/219.1
6,767,154 B1 7/2004 Schwoerer

FOREIGN PATENT DOCUMENTS

DE G 84 23 109.2 1/1986
DE 3545273 6/1987

(Continued)

*Primary Examiner*—Michael P Ferguson
(74) *Attorney, Agent, or Firm*—Walter A. Hackler

(57) ABSTRACT

A turnbuckle device (11) for clamping concrete shell elements (1, 2), having two claws (12, 13), which may be displaced toward one another, and a wedge (18) or the like, the claws (12, 13) having legs (14, 20; 41), the legs (14, 20; 41) having contact surfaces (30, 31; 43) extending in a plane to rest on struts (7, 21; 50) of frames (5, 6) of concrete shell elements (1, 2), the legs (14, 20; 41) having lugs on their free ends (16, 22; 40), which are capable of engaging behind depressions (9, 15) in frames (5, 6) of concrete shell elements (1, 2), is characterized in that an extension (17; 42; 44; 45) is provided on a lug (16; 40) of a leg (14; 41), which extends away from the contact surface (30, 43) at least partially perpendicularly to the plane of the contact surface (30; 43) of the leg (14; 41). The mounting of the turnbuckle device is thus made easier.

3 Claims, 3 Drawing Sheets

FOREIGN PATENT DOCUMENTS

| | | | |
|---|---|---|---|
| DE | 3718615 | A1 | 12/1988 |
| DE | 10047203 | A1 | 6/2001 |
| DE | 100 28556 | C1 | 9/2001 |
| DE | 10028556 | C1 | 9/2001 |
| JP | 49-135038 | | 12/1974 |
| JP | 60-121061 | A | 6/1975 |

* cited by examiner

CONCRETE SHELL ASSEMBLY

BACKGROUND OF THE INVENTION

The present invention relates to a turnbuckle device for clamping concrete shell elements, having two claws, which are displaceable toward one another, and a wedge, the claws having legs, the legs having contact surfaces extending in a plane for contact on struts of frames of concrete shell elements, the legs having lugs on their free ends which are capable of engaging behind depressions in frames of concrete shell elements.

A turnbuckle device according to the species is known, for example, from DE 35 45 273 A1.

Concrete shell elements are used to erect delimitations for concrete bodies to be cast such as building walls. In order to obtain delimitations which may be cemented in, typically multiple concrete shell elements must be connected permanently to one another. Turnbuckles are used to connect the concrete shell elements.

The concrete shell elements essentially comprise a shell skin, a frame, and struts for stabilizing the frame. The turnbuckles are typically positioned in the area of the intersections of struts and frames. Each claw of a turnbuckle encloses a frame section of two concrete shell elements to be connected, and the two claws—and therefore the concrete shell elements—are clamped to one another using a wedge, i.e., the claws are moved toward one another and into one another in a clamping direction.

Turnbuckles of the related art, such as those according to DE 35 45 273 A1, have contact surfaces of legs of the claws resting on the top of transversely running struts of the concrete shell elements. To clamp the turnbuckle, the turnbuckle must first be oriented. In particular, lugs on the free ends of the legs must be inserted into vertically running grooves in the frame sections of the two concrete shell elements. As soon as the lugs of the legs of both claws are simultaneously in position, the wedge may be advanced to clamp the claws.

The object of the present invention is to provide a turnbuckle device which is simpler to orient and mount.

SUMMARY OF THE INVENTION

This object is achieved according to the present invention for a turnbuckle device of the type described at the beginning in that an extension is provided on a lug of a leg, which extends away from the contact surface at least partially perpendicularly to the plane of the contact surface of the leg.

Concrete shell elements are welded to one another in the contact area of frames and struts for stabilization. While a strut, particularly a transverse strut, is implemented as flat on its head area, the frame has a depression or groove in the contact area. The depression or groove is particularly used for the purpose of allowing the lug of the turnbuckle device to engage, through which the turnbuckle device is to be secured in a movement direction perpendicular to the shell skin. The depression or groove in the frame is partially covered by the head area of the strut, so that a cavity remains between strut and frame. If the depression is implemented as a groove, the cavity represents a through opening in the contact area. The strut and frame are only welded at the areas of the strut and frame which actually press against one another, so that the cavity remains after the welding.

The extension on the lug of a leg according to the present invention may project into this cavity. The extension projects away from the contact surface of the lug. In this case, the extension may project both perpendicularly and also diagonally in relation to the contact surface. The extension on the lug assumes a hook function. The claws which the extension belongs to may not be shifted significantly in a direction parallel to the contact service of the leg in a state in which the extension engages in the cavity between frame and strut. Simultaneously, at least one contact surface of a leg of the claw rests on the strut. The position of this claw is thus fixed. This position is suitable for clamping the claw.

If a claw of the turnbuckle device has been fixed by the extension, the other claw of the turnbuckle device may be oriented easily with one hand in order to produce the clamping position of the turnbuckle device.

Subsequently, an assembler may drive the wedge into the turnbuckle device without having to hold the turnbuckle. Overall, the turnbuckle device according to the present invention allows simple and rapid one-hand mounting by an assembler.

If there are no suitable cavities for engagement of the extension in existing concrete shell elements, cavities for the purpose of receiving an extension may also be introduced into the concrete shell elements with low outlay, of course.

To improve the hold of the turnbuckle device, multiple extensions may also be provided on lugs of different legs. The turnbuckle device must then be provided with sufficient play between the two claws to be able to bring the turnbuckle device into a clamping position.

In a preferred embodiment of the turnbuckle device according to the present invention, the extension is provided on a lug of a leg, the leg being able to be applied to a top of a strut in the mounted state of the turnbuckle on two concrete shell elements positioned next to one another in the horizontal direction. In other words, in this embodiment, the extension having a hook function is implemented on one of the top legs of a claw when the clamping direction of the claws runs horizontally. In this case, the suspension of the turnbuckle in the clamping position is especially simple for the assembler, since gravity makes the mounting of the turnbuckle in the typical position (i.e., with horizontal displacement of the claws for clamping) easier by fixing the turnbuckle in this typical position. Gravity acts as an additional means for orientation and fixing. The edges of the extension and the contact surface of the leg of the extension define the position of the claw of the leg having the extension.

In another advantageous embodiment, the extension is positioned on a lug of a leg of a first claw of the two claws, and the wedge is held guided in the second claw. In this case, only the second claw is movable as the wedge advances, while the first claw remains fixed in place. The mechanical load of the extension during the mounting procedure is thus kept small.

Furthermore, an embodiment in which the extension is implemented as a hook is advantageous. In particular, the extension may have a projection on its end facing away from the contact surface, which extends back toward the contact surface at least partially parallel to the contact surface. Suitable depressions on the head end of the strut may be provided for improving the engagement of the hook. The extension may also extend completely through the cavity between strut and frame and the projection may in turn enclose the strut. The hold of the claw on the concrete shell elements may thus be improved.

Further advantages of the present invention result from the description and the drawing. The above-mentioned features and the features explained in the following may also each be used individually or in arbitrary combinations. The embodiments shown and described are not to be understood as a complete list, but rather have exemplary character for the description of the present invention. It is obvious that the claws of the turnbuckle according to the present invention do not necessarily have to be clamped using a wedge, because arbitrary clamping means do not influence the idea of the present invention.

The present invention is illustrated in the drawing and will be explained in greater detail on the basis of exemplary embodiments.

DESCRIPTION OF THE PREFERRED EMBODIMENT

Figure 1A:
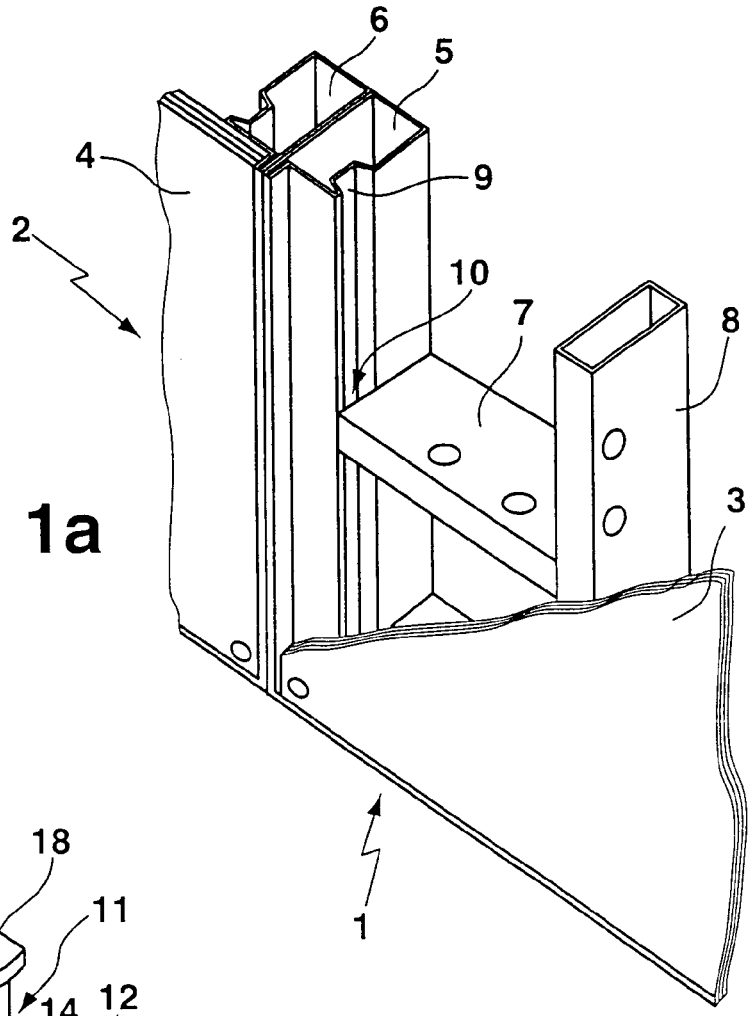
FIG. 1*a* shows a schematic illustration of concrete shell elements, a cavity being provided between a transverse strut and a frame section.

FIG. 1*a* shows a schematic illustration of typical concrete shell elements 1 and 2, which are positioned horizontally neighboring one another and are to be connected solidly to one another. The concrete shell elements each have a shell skin 3, 4. Liquid concrete compound is to be cast and hardened on the side of the shell skins 3, 4 lying in front in FIG. 1. Frames 5, 6 are implemented on the outer edges on each of the backs of the shell skins 3, 4. The frames 5, 6 are reinforced and stiffened by struts 7, 8. The strut 7 is implemented as a transverse strut and is welded to the frame 5 at its left head end in the figure. The frame 5 has a groove-shaped depression 9, which extends in the vertical direction over the entire section of the frame 5 shown. In particular, the depression 9 also runs behind the left head end of the strut 7, through which a cavity 10 remains between the head end of the strut 7 and the frame 5 in the form of a through opening.

Figure 1B:
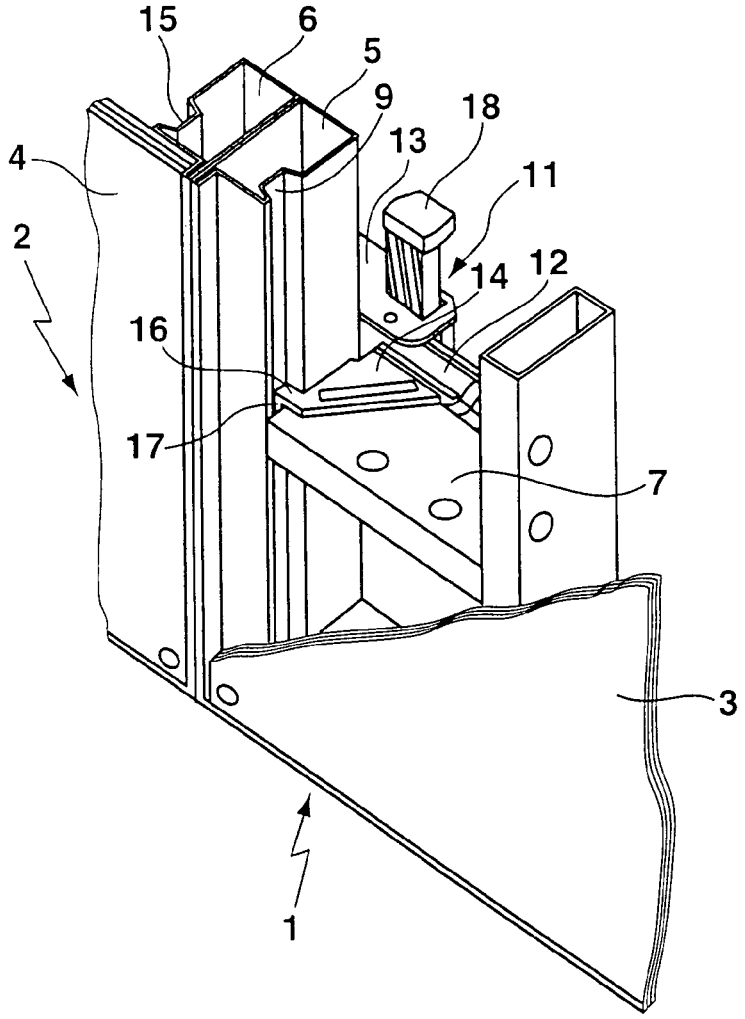
FIG. 1*b* shows a schematic illustration of the concrete shell element of FIG. 1*a* having a turnbuckle device according to the present invention.

FIG. 1*b* shows the concrete shell elements 1, 2, which are connected to one another using a turnbuckle device 11 according to the present invention. The turnbuckle device 11 has a first claw 12 and a second claw 13, as well as a wedge 18. The two claws 12, 13 each have two legs, of which only an upper leg 14 of the first claw 12 may be seen in FIG. 1*b*, while the other legs are covered. The legs enclose the frames 5, 6 above and below transverse struts, of which only the strut 7 is visible. In this case, contact surfaces of the upper legs lie on the transverse struts. Furthermore, lugs on the front free ends of the legs engage in groove-shaped depressions 9, 15 of the frames 5, 6.

A lug 16 of the leg 14 engages in the depression 9 of the frame 5. On the bottom of the lug 16, i.e., on the side of the leg 14 which also represents the contact surface of the leg 14 on the strut 7, the lug 16 has an extension 17 projecting downward. This projects into the cavity between strut 7 and frame 5. The extension 17 blocks displacement of the leg 14 in the direction to the right on the strut 7. The remaining parts of the lug 16 block displacement of the leg 14 in all other directions parallel to the contact plane of the leg 14 on the strut 7, particularly toward the shell skin 3 or away from it or toward the other concrete shell element 2. Therefore, the leg 14 and the claw 12 of the turnbuckle device 11 connected to this leg 14 are largely fixed in place. Only slight play remains of the mobility for hooking and unhooking the leg 14.

The turnbuckle device 11 therefore only still has one degree of freedom, specifically the position of the second claw 13 in relation to the fixed first claw 12. In this case, the claws 12, 13 are guided like rails one inside the other in the clamping direction. The degree of freedom of the second claw 13 may therefore be controlled easily with one hand by an assembler. This makes mounting easier.

Figure 2:
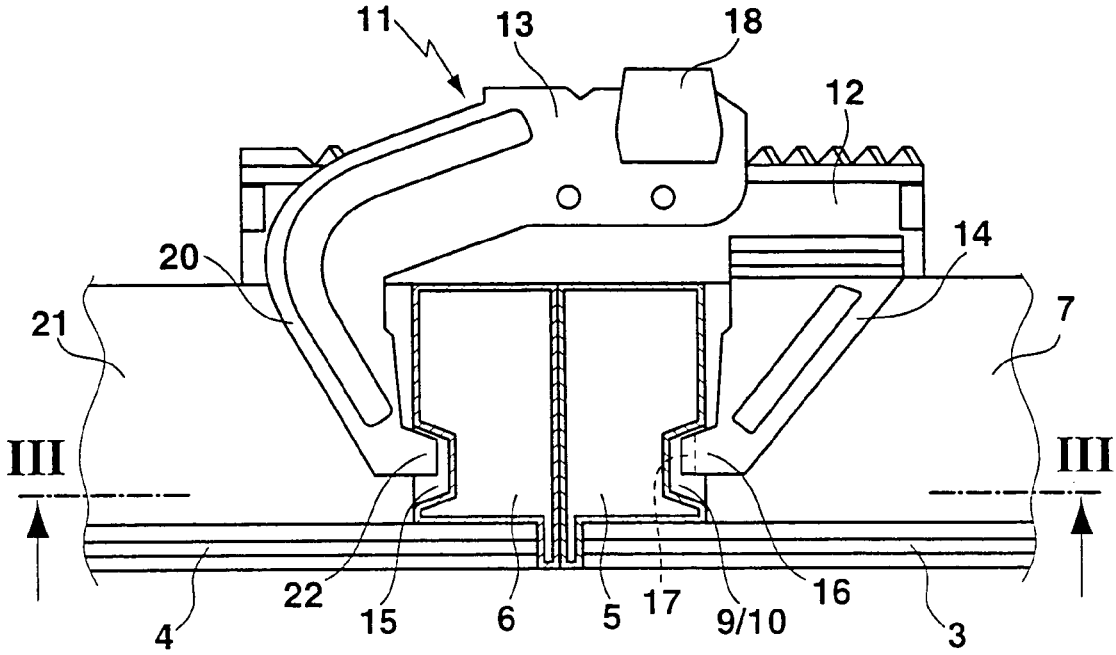
FIG. 2 shows a schematic sectional illustration of the turnbuckle device according to the present invention from FIG. 1*b* in a horizontal plane.

FIG. 2 shows a schematic illustration of a horizontal section through FIG. 1*b* just above the turnbuckle device 11 with a view downward. The turnbuckle device 11 comprises the first claw 12, the second claw 13, and the wedge 18. By advancing the wedge 18, a relative motion of the claws 12, 13 toward one another (in FIG. 2: first claw 12 to the left and/or second claw 13 to the right) may be caused for the purpose of clamping. The turnbuckle device 11 is applied loosely and ready for clamping in the state shown. The claws 12, 13 have legs 14, 20 whose bottoms rest on the tops of struts 7, 21 as contact surfaces.

Lugs 16, 22, which engage in the groove-shaped depressions 9, 15 of the frames 5, 6, are positioned on the free ends of the legs 14, 20 facing toward one another. A movement of the turnbuckle device 11 away from the shell skins 3, 4 in a direction perpendicular to the plane of the shell skins 3, 4 is thus prevented. A movement of the turnbuckle device 11 toward the shell skins 3, 4 is blocked by the application of the first claw 12 to the frames 5, 6.

In order to block movement of the first claw 12 in FIG. 2 to the right, the lug 16 of the leg 14 of the first claw 12 has the extension 17, which extends into the plane of the drawing of FIG. 2 and may come to rest on a lateral surface of the strut 7.

Figure 3:
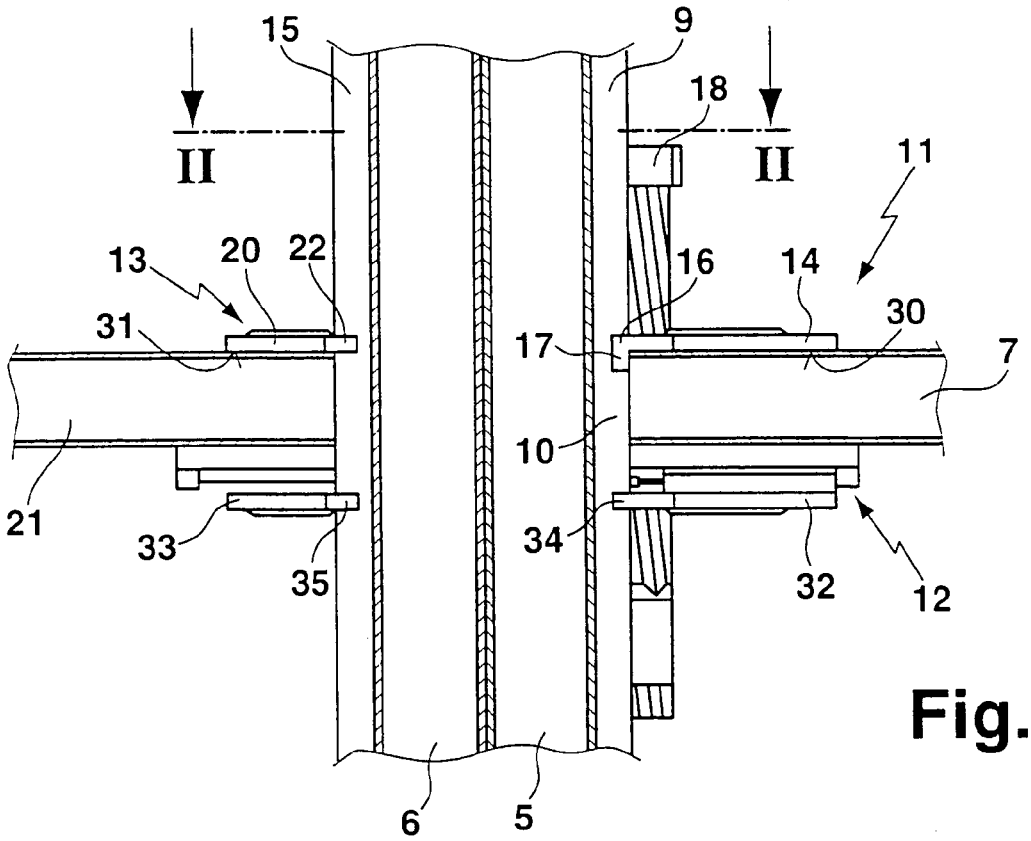
FIG. 3 shows a schematic sectional illustration of the turnbuckle device according to the present invention from FIG. 1*b* in a vertical plane.

This may be seen better in the vertical sectional illustration of FIG. 3. The sectional plane of FIG. 3 is marked with "III" in FIG. 2. Vice versa, the sectional plane of FIG. 2 is marked with "II" in FIG. 3.

The bottoms of the legs 14 and 20, specifically the contact surfaces 30, 31, rest on the tops of the struts 7, 21. A lower leg 32 of the first claw 12 and a lower leg 33 of the second claw 13 are also visible in FIG. 3. All legs 14, 20, 32, 33 have lugs 16, 22, 34, 35 projecting into the groove-shaped depressions 9, 15 of the frames 5, 6. The extension 17, which points away from the contact surface 30, is located on the lug 16 of the leg 14. In the case shown, the extension 17 projects perpendicularly away from the plane of the contact surface 30. The extension 17 encloses the left upper edge of the strut 7 in FIG. 3. A movement of the leg 14 to the right in FIG. 3 is thus blocked, since the extension 17 opposes this movement like a hook. As long as the turnbuckle device 11 is not lifted against the force of gravity, the first claw 12 is fixed by the extension 17, which extends into the cavity 10 between strut 7 and frame 5. The first claw 12 only has play in that the width of the extension 17 is less than the depth of the groove-shaped depression 9. The width of the extension 17 may be tailored to the depth of the depression 9 according to the present invention to minimize the play.

The lower legs 32, 33 are spaced from the bottom of the struts 7, 21 by more than the length of the extension 17 projected on the normal line of the contact surfaces 30, 31 (=vertical length of the extension 17), in order to allow the extension 17 to be lifted out of the cavity 10. The lower legs 32, 33 therefore do not require flat contact surfaces for contact on the bottoms of the strut 7, 21.

Figure 4A:
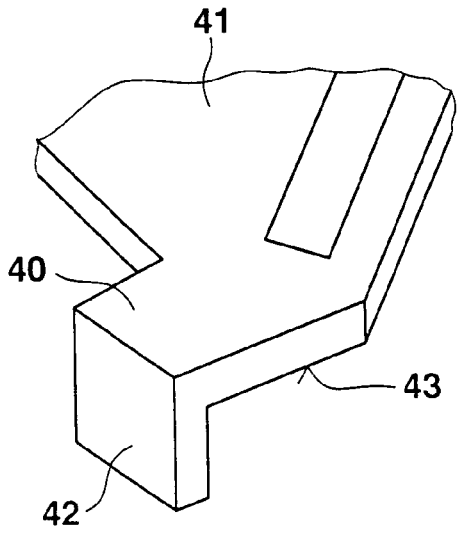
FIG. 4*a* shows the lug of a leg of a claw of a turnbuckle device according to the present invention having an extension projecting perpendicularly from the contact surface.
Figure 4B:
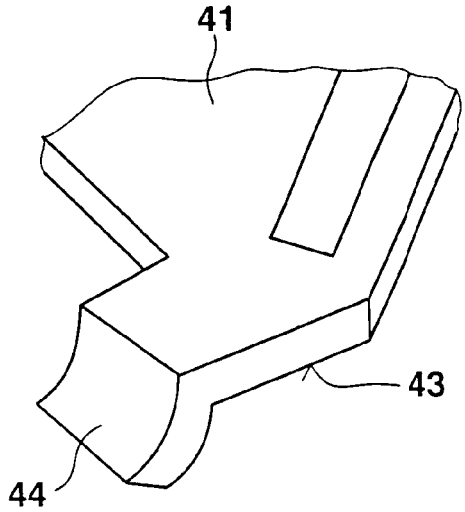
FIG. 4*b* shows the lug of a leg of a claw of a turnbuckle device according to the present invention having an extension projecting diagonally from the contact surface.
Figure 4C:
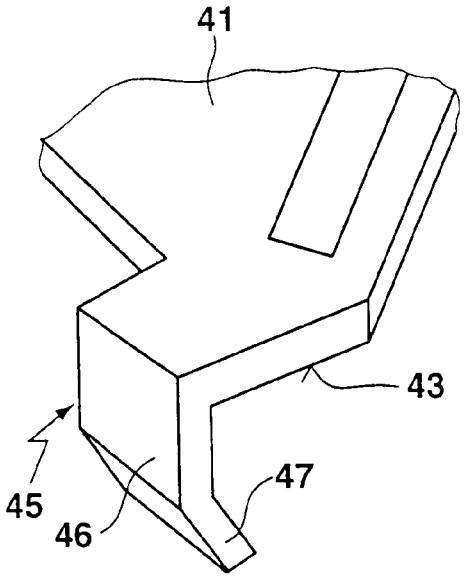
FIG. 4*c* shows the lug of a leg of a claw of a turnbuckle device according to the present invention having an extension implemented as a hook.

FIGS. 4*a* through 4*c* show possible embodiments according to the present invention of the extensions on the lug of a leg. FIG. 4*a* shows the simplest embodiment, which is also implemented in FIGS. 1*b*, 2, and 3. An extension 42, which extends perpendicularly away from the plane of a contact surface 43, is attached to a lug 40 which is positioned on the free end of a leg 41. The contact surface 43 is essentially the bottom of the leg 41 in FIG. 4*a*.

An extension 44 which extends in a curve away from the contact surface 43 is shown in FIG. 4*b*. Observed as a vector, the curve of the extension 44 has a component which projects away perpendicularly from the contact surface 43 and a component which extends parallel to the contact surface 43. The extension 44 thus extends away from the contact surface 43 partially perpendicularly to the plane of the contact surface 43. In a further embodiment of an extension, it is advantageous if the vector component of the extension running perpendicular to the contact surface of the leg is always larger than the component of the extension running parallel to the contact surface.

FIG. 4*c* shows an extension 45 which is implemented as a hook. The extension 45 has a first section 46, which extends away perpendicularly from the contact surface 43, and a second section 47, which has a vector component parallel to the contact surface 43 and faces toward the main part of the leg 41. The second section 47 may also be implemented as a projection on the first section 46. A part of the extension 45, the second section 47 here, is bent back toward the leg 41 in a way.

Figure 4D:
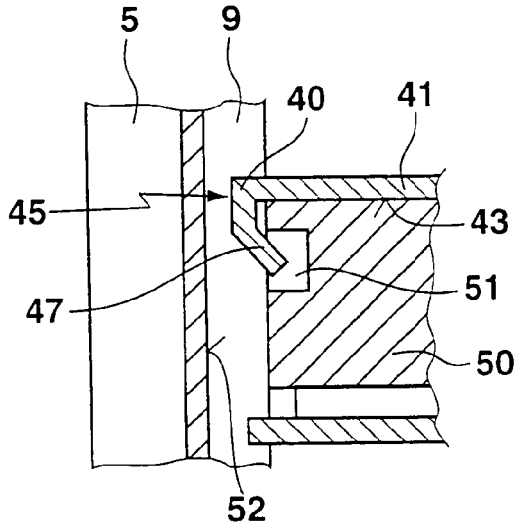
FIG. 4*d* shows a schematic vertical section through the lug of FIG. 4*c* in the mounted state on a strut having a depression for the engagement of the hook.

The hook-shaped extension 45 is provided for use with specially designed struts, of which one possible strut 50 is shown in a vertical section in FIG. 4*d*. The strut 50 has a recess 51 on its head side facing toward the frame 5, which is provided for the engagement of the second section 47 of the hook-shaped extension 45. In this geometry, the leg 41 may only be raised from the strut 51 when the lug 40 and/or the leg 41 has been shifted to the inner edge 52 of the groove-shaped depression 9. This may be taken into consideration easily by an assembler as the leg 41 is threaded in and out, but the probability of the associated claw unintentionally sliding out of a position allowing clamping is greatly reduced. The mounting of the turnbuckle device according to the present invention is thus made easier.

In order to make the mounting of a turnbuckle device for concrete shell elements easier, an extension, which may be inserted into a cavity on a concrete shell elements, is attached to at least one free end of the leg which is provided for contact on the strut of a concrete shell element. The extension has a hook function and fixes the leg and therefore at least a part of the turnbuckle device in a position suitable for clamping the turnbuckle device.

I claim:

1. A concrete shell assembly comprising:

two concrete shell elements (1, 2), each concrete shell element comprising frames (5, 6), with transverse struts (7, 21, 50) attached therebetween, respective frames of the shell elements being abutable with one another, each frame comprising a longitudinally extending groove-shaped depression (9) providing a cavity (10) between the frame and a corresponding attached strut;

a turnbuckle device (11) clamping the respective frames and concrete shell elements together, the turnbuckle device comprising:

two claws (12, 13), displaceable toward one another, each claw comprising a pair of spaced legs (14, 20; 41) each having a respective contact surface (30, 31; 43) extending in a plane parallel to and engaging an outer surface of a corresponding strut received between the pair of legs, a wedge (18) interlockingly engaging each claw for fixing the claws relative to one another in a clamping position;

a lug (16, 40) disposed on and planar with an outer free end (16, 22; 40) of each of the legs for engaging the depression in a corresponding frame; and an extension (17; 42; 44; 45) disposed on the lug of one of the legs of the two claws, the extension extending transverse to the contact surface of the one leg and projecting into the cavity between the strut and the frame of one of the concrete shell elements thereby holding the turnbuckle device in position as the claws are displaced toward one another;

wherein each end of each strut includes a recess (51), facing the depression of a corresponding attached frame, and the extension has a hook shape with a second section (47) disposed at a free end of the extension bent inwardly toward the one leg and disposed for entering the recess.

2. The assembly according to claim 1, wherein the extension (17; 42; 44; 45) disposed on the lug (16; 40) of the one leg (14; 41), and the one leg are is disposable on a top of a strut (7) in a mounted state of the turnbuckle device (11) on two concrete shell elements (1, 2) positioned next to one another in the horizontal direction.

3. The assembly according to claim 1, wherein the extension (17; 42; 44; 45) is positioned on a lug (16; 40) of a leg (14; 41) of a first claw (12) of the two claws (12, 13), and the wedge (18) is held guided in the second claw (13).

* * * * *